US007797840B2

(12) United States Patent
Bublitz et al.

(10) Patent No.: US 7,797,840 B2
(45) Date of Patent: Sep. 21, 2010

(54) STUD PUNCH

(75) Inventors: Scott D. Bublitz, Hartland, WI (US); Edward D. Wilbert, Hubertus, WI (US); Jonathan A. Zick, Waukesha, WI (US); Richard H. Jungmann, Richfield, WI (US); David B. Griep, Rubicon, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 502 days.

(21) Appl. No.: 11/782,954

(22) Filed: Jul. 25, 2007

(65) Prior Publication Data

US 2008/0210076 A1 Sep. 4, 2008

Related U.S. Application Data

(60) Provisional application No. 60/833,130, filed on Jul. 25, 2006.

(51) Int. Cl.
*B26F 1/14* (2006.01)

(52) U.S. Cl. ..... 30/358; 30/362

(58) Field of Classification Search ..... 30/358, 30/360, 362, 363, 366, 367, 368; 74/55
See application file for complete search history.

(56) References Cited

U.S. PATENT DOCUMENTS 4,571,975 A * 2/1986 Pawloski et al. ..... 30/368
4,899,447 A 2/1990 Adleman
4,905,557 A 3/1990 Adleman
D310,009 S 8/1990 Freiwald
5,142,958 A 9/1992 Nordlin et al.
5,287,716 A 2/1994 Szulc
5,416,975 A * 5/1995 Saito et al. ..... 30/362
5,598,635 A 2/1997 Saito
D433,903 S 11/2000 Shigo et al.
6,367,362 B1 4/2002 Brazell et al.
6,378,217 B1 * 4/2002 Takamura et al. ..... 30/362
6,523,445 B2 2/2003 Bender
D475,907 S * 6/2003 Neitzell et al. ..... D8/61
6,622,601 B2 9/2003 Hashimoto et al.
6,647,630 B1 11/2003 Lucas et al.
6,698,324 B2 3/2004 Hashimoto et al.
6,772,521 B2 8/2004 Nordlin et al.
6,915,579 B2 7/2005 Cofer
6,973,729 B2 12/2005 Nordlin
6,981,327 B2 1/2006 Nordlin

OTHER PUBLICATIONS

ThomasNet Industrial Newsroom, "ThomasNet ProductNewsRoom Powered by Product News Network" http://news.thomasnet.com/printready.html?prid=16588, 2 pages, Jun. 27, 2007.

* cited by examiner

*Primary Examiner*—Stephen Choi
(74) *Attorney, Agent, or Firm*—Michael Best & Friedrich LLP

(57) ABSTRACT

A stud punch head for a power tool includes a head housing and a first arm movably coupled to the head housing. The first arm supports a punch. The stud punch head also includes a second arm movably coupled to the head housing and relative to the first arm. The second arm supports a die opposite the punch. The stud punch head also includes a drive mechanism positioned at least partially within the head housing and operatively coupled to a motor of the power tool. The drive mechanism is operable to move the first arm and the second arm toward and away from each other.

32 Claims, 9 Drawing Sheets

STUD PUNCH

CROSS-REFERENCE TO RELATED APPLICATIONS

This application claims priority to U.S. Provisional Patent Application No. 60/833,130, entitled "Stud Punch", filed Jul. 25, 2006 by David B. Griep, Scott D. Bublitz, Edward D. Wilbert, and Jonathan A. Zick, the entire contents of which is hereby incorporated by reference.

BACKGROUND

The present invention relates to a stud punch, and in particular, to a battery-operated stud punch.

Presently, manual, or mechanical, stud punches are used by electricians and plumbers to punch holes in steel studs, allowing plumbing, wires, and/or other materials to be run through the studs. Such tools are bulky, expensive, and, in certain scenarios, are difficult to manipulate in confined areas where the studs may be located. For example, typical manual stud punches only allow a user to punch the studs from one direction, thereby limiting or inhibiting the amount of leverage the user may apply to the tool. As such, a manual stud punch typically is only used to punch a hole in a single stud. In addition, while using a manual stud punch, a user can typically only punch holes in twenty to twenty-five gauge steel studs. Typically, only the punch or the die moves when the user actuates the stud punch, requiring the stud to be oriented in one particular orientation.

Furthermore, manual stud punches require a large amount of strength and exertion from the user to punch holes in the studs. If the user is required to punch many holes in a single day or in a short period of time, the user may become susceptible to repetitive stress injury (RSI).

SUMMARY

In one embodiment, the invention provides a stud punch head for a power tool. The stud punch head includes a head housing and a first arm movably coupled to the head housing. The first arm supports a punch. The stud punch head also includes a second arm movably coupled to the head housing and relative to the first arm. The second arm supports a die opposite the punch. The stud punch head further includes a drive mechanism positioned at least partially within the head housing and operatively coupled to a motor of the power tool. The drive mechanism is operable to move the first arm and the second arm toward and away from each other.

In another embodiment, the invention provides a power tool including a housing, a motor positioned substantially within the housing, and a stud punch head coupled to the housing. The stud punch head includes a first arm movable with respect to the housing. The first arm supports a punch. The stud punch head also includes a second arm movable with respect to the housing. The second arm supports a die opposite the punch. The stud punch head further includes a drive mechanism operatively coupled to the motor. The drive mechanism is operable to move the first arm and the second arm toward and away from each other In yet another embodiment, the invention provides a power tool including a housing, a motor positioned substantially within the housing, and a first arm movably coupled to the housing. The first arm supports a punch. The power tool also includes a second arm movably coupled to the housing and relative to the first arm. The second arm supports a die opposite the punch. The power tool further includes a drive mechanism positioned at least partially within the housing and operatively coupled to the motor. The drive mechanism is operable to move the first arm and the second arm between a first position, whereby the punch is spaced apart from the die, and a second position, whereby the die receives a portion of the punch.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

DETAILED DESCRIPTION

Figure 1:
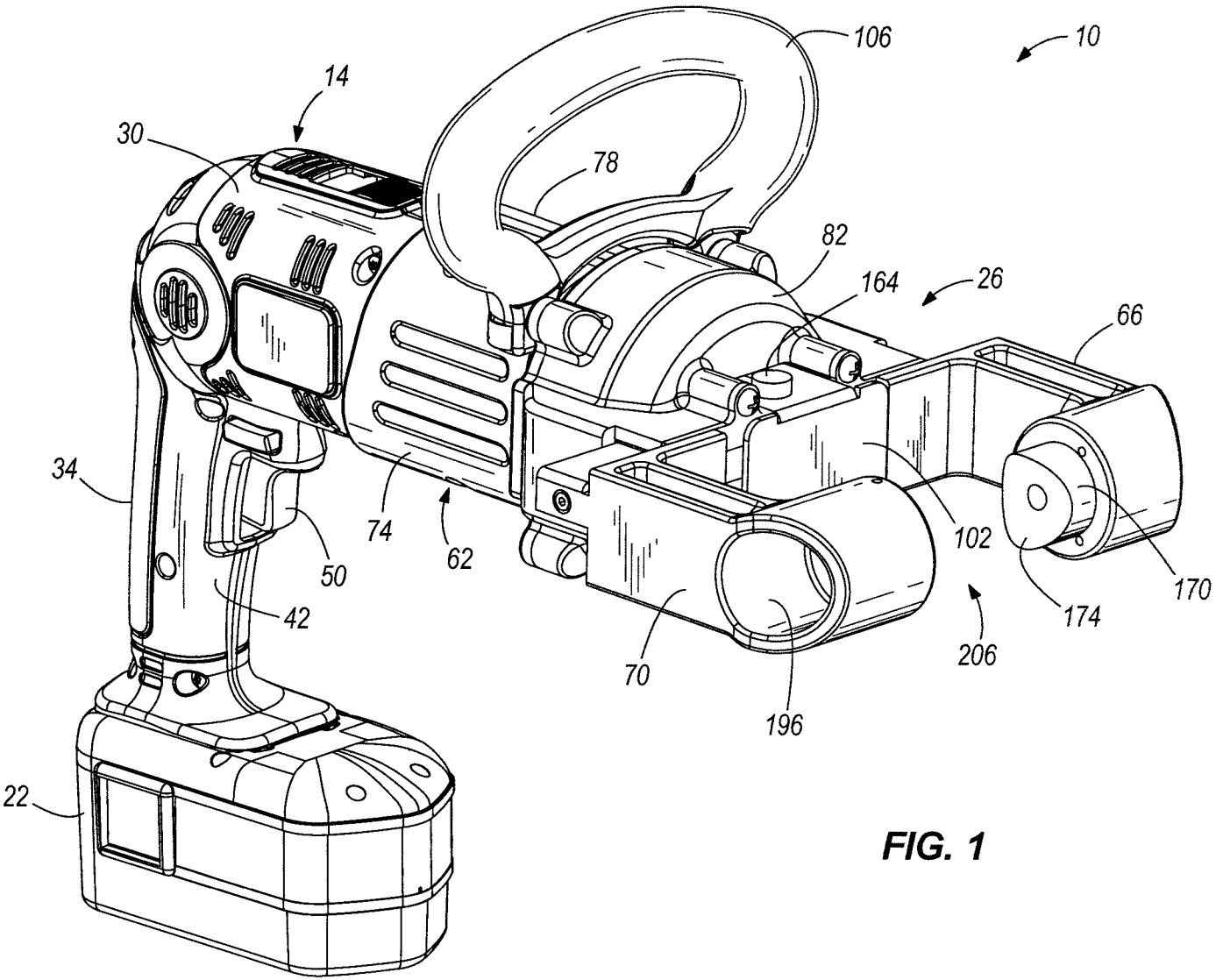
FIG. 1 is a perspective view of a stud punch according to one embodiment of the invention, the stud punch including a housing in a bent position.
Figure 2:
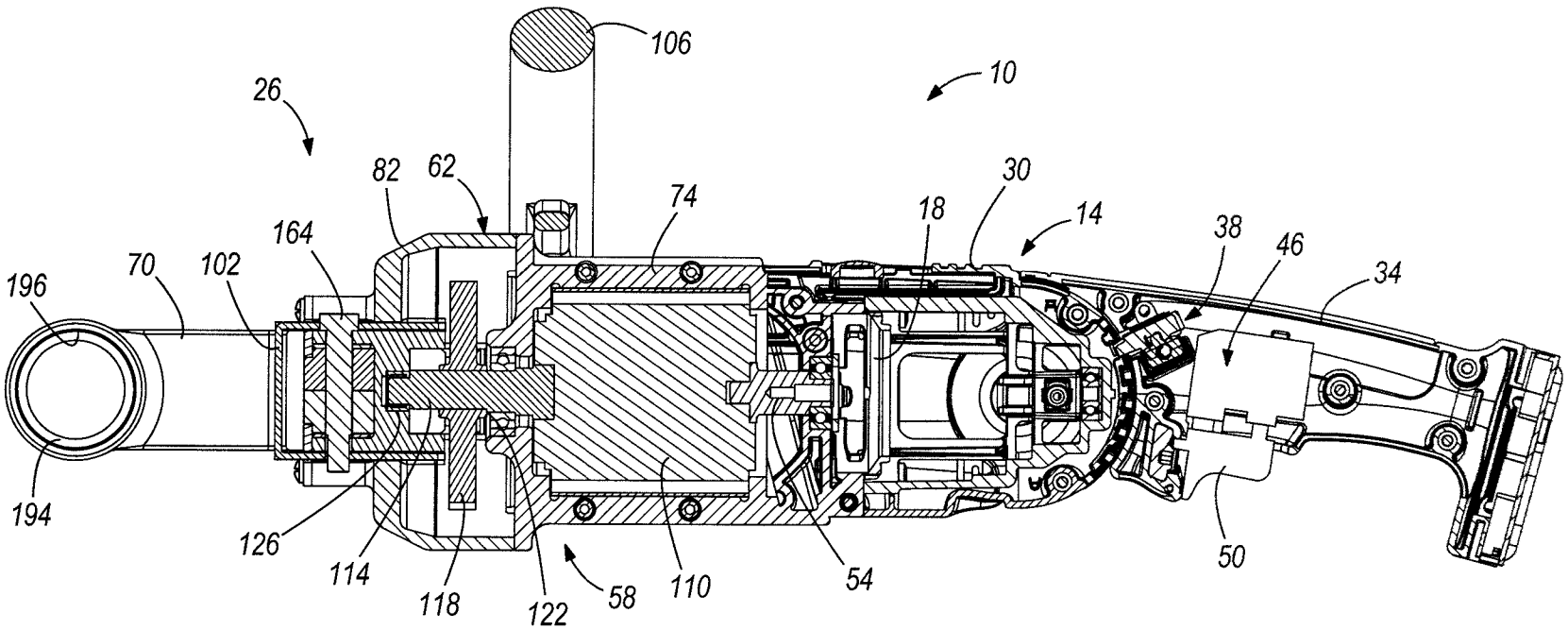
FIG. 2 is a cross-sectional view of the stud punch shown in FIG. 1 with the housing in an inline position.

FIGS. 1 and 2 illustrate a power tool such as, for example, a stud punch 10. The stud punch 10 is operable to create (e.g., punch) a hole in a stud 210 (FIG. 4B) to facilitate running wires and/or plumbing, as well as other materials, through the stud 210. In the illustrated construction, the stud punch 10 is configured to receive 2×4 or 2×6 studs, with other size studs also being receivable by the stud punch 10. In some constructions, the stud punch 10 may be operable to punch holes in sixteen to twenty-five gauge steel studs.

The illustrated stud punch 10 includes a housing 14, a motor 18 (FIG. 2) positioned within the housing 14, a power supply 22 removably coupled to one end of the housing 14, and a stud punch head 26 coupled to the other end of the housing 14. In the illustrated embodiment, the housing 14 includes a first portion 30 and a second portion 34 pivotally coupled together. The second housing portion 34 is movable relative to the first portion 30 between an inline position (FIG. 2) and a bent position (FIG. 1), with intermediate positions also being obtainable. As shown in FIG. 2, a detent assembly 38 is formed in the housing 14 at a connection area between the first portion 30 and the second portion 34. The detent assembly 38 defines and partially retains the housing portions 30, 34 in the inline, bent, and intermediate positions. Movement between the inline and bent positions facilitates manipulation and operation of the stud punch 10 in areas that may otherwise be inaccessible or difficult to reach.

The second portion 34 of the housing 14 includes a handgrip 42 configured to be grasped by a user. A switch assembly 46 is supported on the second portion 34 proximate the handgrip 42 and is actuatable to operate the stud punch 10. The switch assembly 46 includes a trigger 50 that may be depressed by a user to electrically connect the power supply 22 and the motor 18, thereby supplying power to the motor 18.

As shown in FIG. 2, the motor 18 is positioned substantially within the first portion 30 of the housing 14. The motor 18 is electrically coupled to the power supply 22 and includes a motor shaft 54, or output shaft, coupled to a drive mechanism 58 of the stud punch head 26. In the illustrated embodiment, the motor 18 is an electric motor configured to rotate the drive mechanism 58. In other embodiments, the motor 18 may be a hydraulic motor, a pneumatic motor, or the like.

The power supply 22 is coupled to the second portion 34 of the housing 14 to selectively provide power to the motor 18. In the illustrated embodiment, the power supply 22 is a rechargeable battery pack that may be removed from the stud punch 10 and interchanged with another battery pack. For example, the battery pack may be an 18-volt removable power tool battery pack that includes five Lithium-ion battery cells. In other embodiments, the battery pack may include fewer or more battery cells and/or battery cells having a chemistry other than Lithium-ion, such as, for example, Nickel Cadmium or Nickel Metal-Hydride. In yet another embodiment, the power supply 22 may be a dedicated battery contained partially or entirely within the housing 14.

In some embodiments, the stud punch 10 may additionally or alternatively include an electrical cord configured to plug the stud punch 10 directly into a wall outlet to charge the battery pack and/or to provide power to the motor 18. In another embodiment, an overload circuit may be electrically positioned between the power supply 22 and the motor 18 to inhibit the motor 18 from drawing too much current from the power supply 22 and shorting.

Figure 3A:
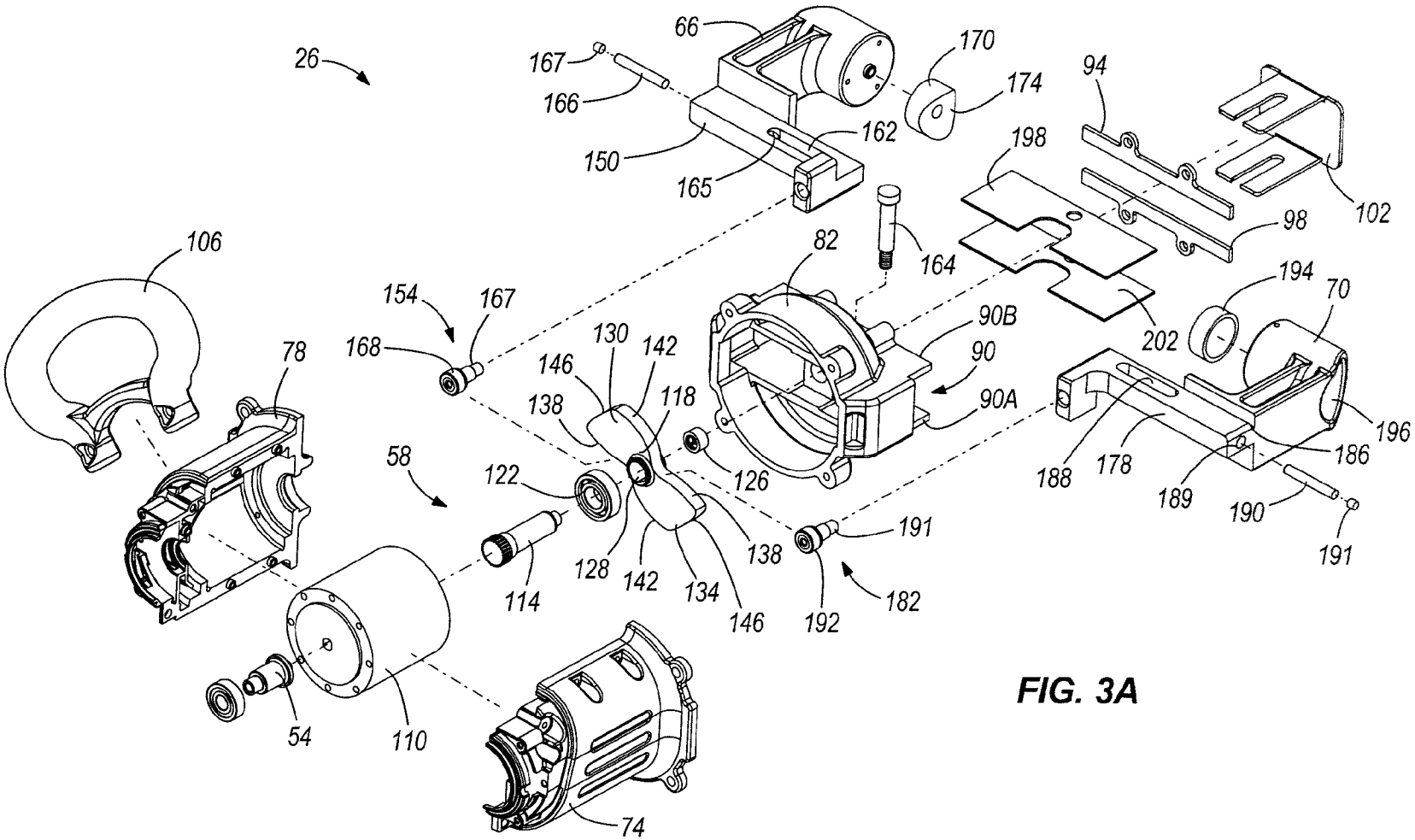
FIG. 3A is a rear exploded view of a stud punch head of the stud punch shown in FIG. 1.
Figure 3B:
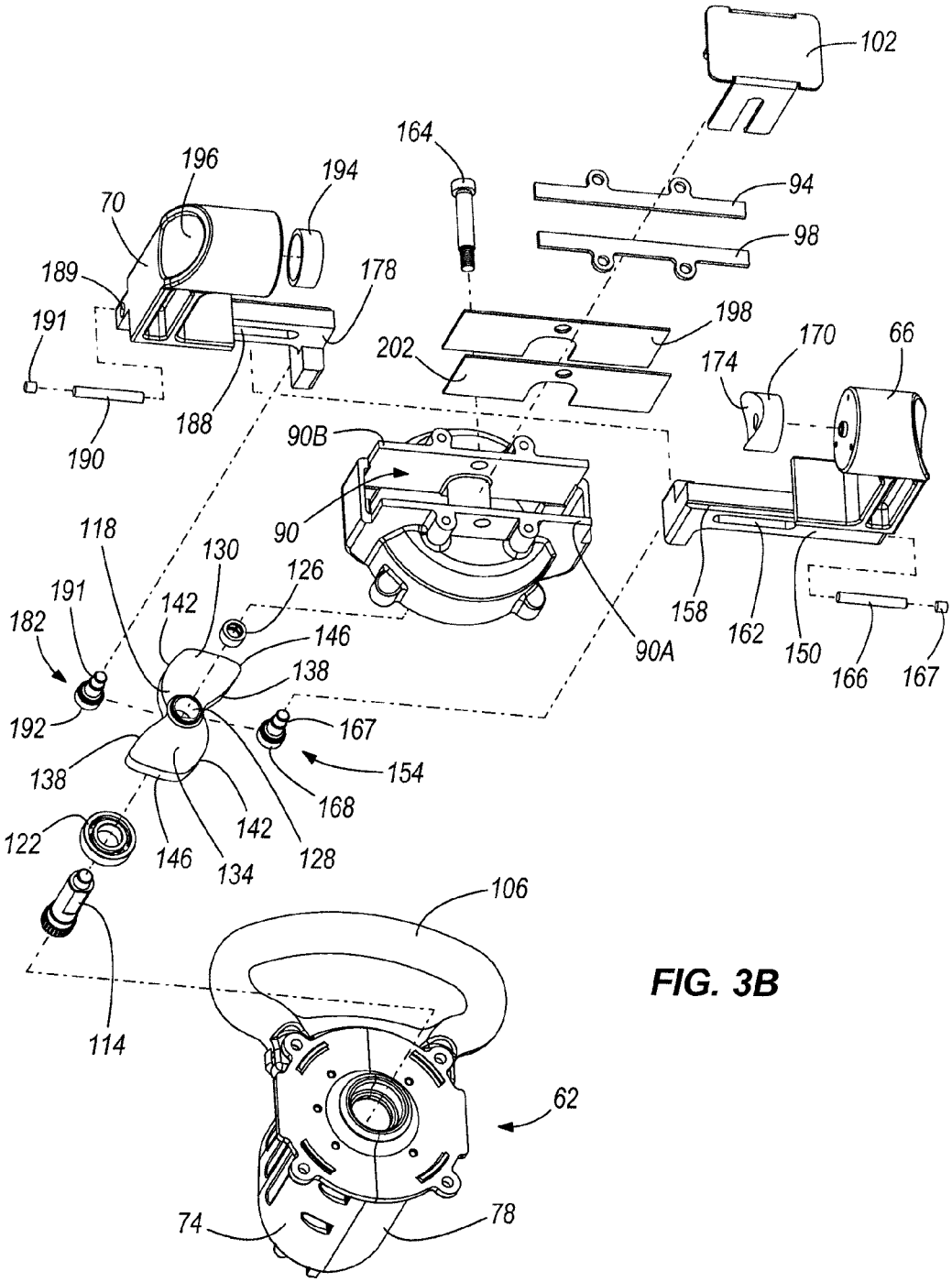
FIG. 3B is a front exploded view of the stud punch head shown in FIG. 3A.
Figure 4A:
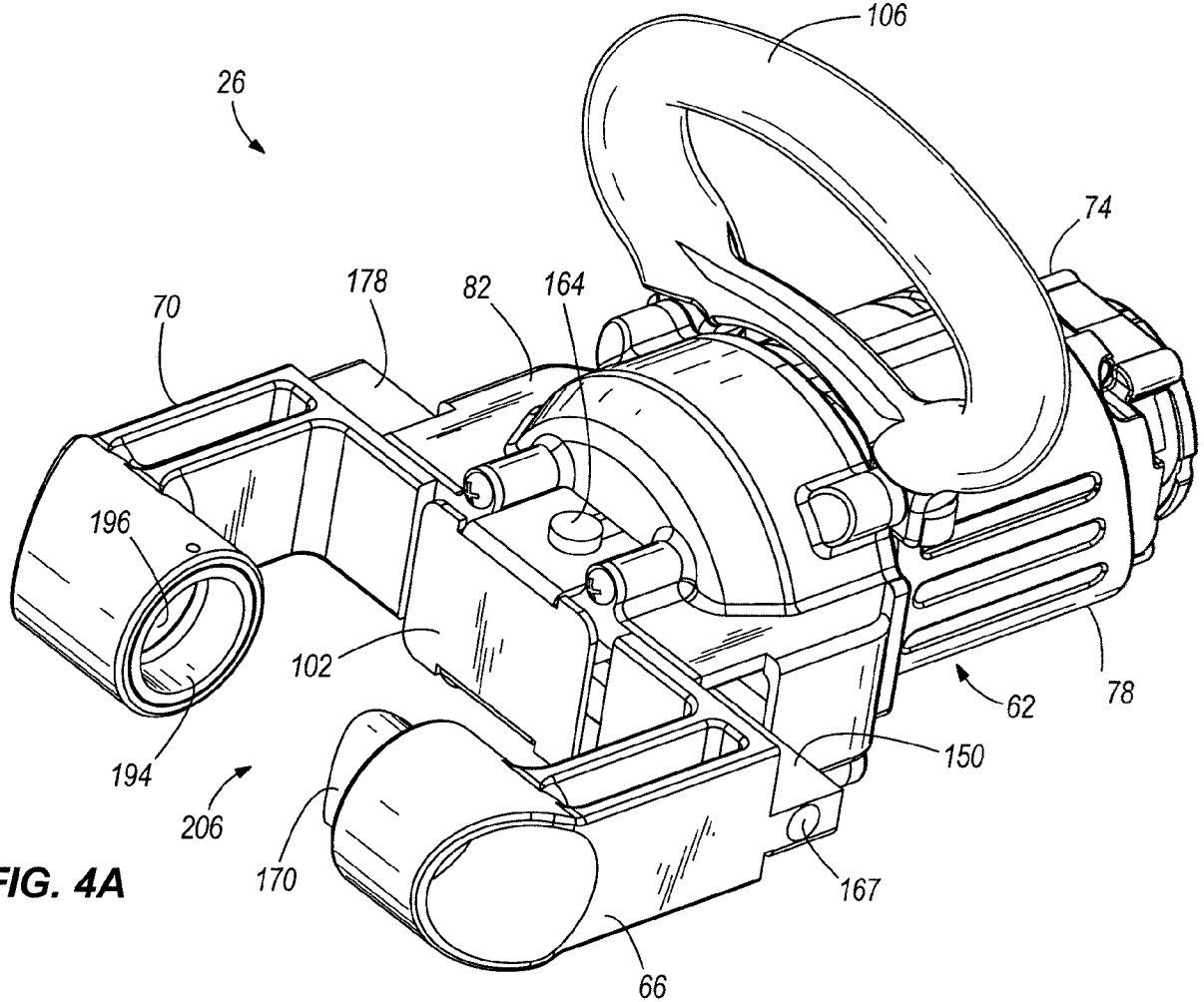
FIG. 4A is a top perspective view of the stud punch head shown in FIG. 3A, the stud punch head including arms in an open position.

As shown in FIGS. 3A, 3B, and 4A, the stud punch head 26 includes a head housing 62, the drive mechanism 58 positioned within the head housing 62, and a first arm 66 and a second arm 70 movably coupled to the head housing 62. In the illustrated embodiment, the head housing 62 is formed by two side portions 74, 78 and a front portion 82 securely coupled together with fasteners. The assembled head housing 62 is coupled to the first housing portion 30 such that the motor shaft 54 engages the drive mechanism 58. In some embodiments, the head housing 62 may be a formed as a single component with the housing 14 or considered part of the housing 14.

Figure 6:
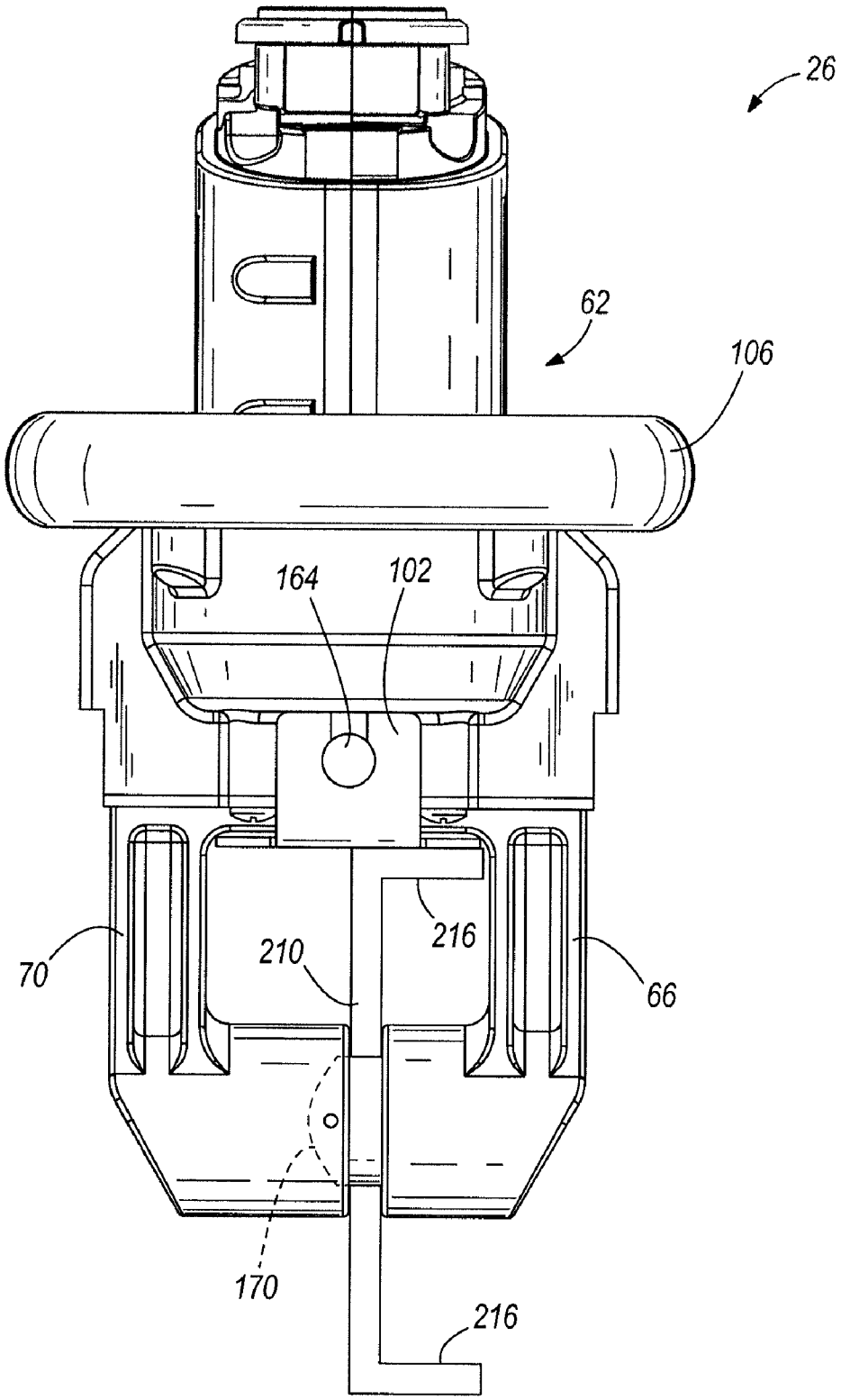
FIG. 6 is a top view of the stud punch head shown in FIG. 3A, with the arms in a closed position.

The front portion 82 of the housing 62 includes a track 90 configured to receive portions of the first and second arms 66, 70 and defining a path along which the arms 66, 70 move (e.g., slide) between an open position, or deactivated position, (FIG. 4B) and a closed position, or activated position, (FIG. 6). Two rails 94, 98 are coupled to the front portion 82 of the head housing 62 on upper and lower sides 90A, 90B of the track 90, respectively, such that a portion of each rail 94, 98 extends into the track 90. The rails 94, 98 engage the arms 66, 70, as further described below, to facilitate alignment and linear movement of the arms 66, 70 relative to the head housing 62.

An end bracket, or shoe, 102 is coupled over a portion of the track 90 and the rails 94, 98 to enclose the portions of the arms 66, 70 within the track 90 and inhibit foreign particles (e.g., dust, dirt, chips, etc.) from entering the track 90 and disrupting the movement of the arms 66, 70. The end bracket 102 is also adjustable (i.e., movable toward and away from the front portion 82) to provide a depth guide for the stud punch head 26. During operation of the stud punch 10, the end bracket 102 is pressed, or rests, against a stud to help a user steady the stud punch 10 and punch the stud at a desired punching location. Sliding the end bracket 102 relative to the front portion 82 allows the user to account for different size studs, as well as punching holes at different depths on the stud, while still allowing the user to rest the stud punch 10 against the stud.

The stud punch head 26 also includes a handle 106 coupled to the head housing 62. The illustrated handle 106 extends upward from the stud punch head 26 such that a user can grasp and operate the stud punch 10 in a manner similar to a chainsaw. In some embodiments, a switch (e.g., a dummy switch) may be positioned on the handle 106 and depressible by the user to operate the stud punch 10. In such a construction, both the trigger 50 on the second portion 34 of the housing 14 and the switch on the handle 106 are depressed in order to operate the stud punch 10, ensuring the user grasps the stud punch 10 with both hands during operation. In other embodiments, the switch may be positioned on the first portion 30 of the housing 14 or elsewhere on the stud punch head 26.

Referring to FIGS. 2 and 3A, the illustrated drive mechanism 58 includes a gear box 110, a drive shaft 114, and a cam 118. In other embodiments, other suitable drive mechanisms having different components may be used. The gear box 110, or gear reduction mechanism, is positioned between the motor shaft 54 and the drive shaft 114 to reduce the amount of output revolutions by the motor shaft 54 into a suitable number of revolutions for the drive shaft 114. For example, in some embodiments, the gear box 110 may include five gears configured to provide a 512:1 reduction between the motor shaft 54 and the drive shaft 114. In other embodiments, fewer or more gears may be used and/or the gear reduction may be greater or lesser.

The drive shaft 114 is rotatably coupled to the gear box 110 and is supported by a ball bearing 122 positioned between the cam 118 and the gear box 110. A needle bearing 126 is positioned on an end of the drive shaft 114 opposite from the gear box 110. The drive shaft 114 is rotated by the motor shaft 54 through the gear box 110 to thereby rotate the cam 118.

The cam 118 is supported within the head housing 62 on the drive shaft 114 between the ball bearing 122 and the needle bearing 126. The illustrated cam 118 includes a D-shaped aperture 128 such that the cam 118 rotates with the drive shaft 114 and, thereby, the motor 18. In other embodiments, the cam 118 may be splined or otherwise fixed to the drive shaft 114 for rotation therewith. In the illustrated embodiment, the cam 118 has a generally propeller-shape and includes two wings 130, 134. Each wing 130, 134 includes an inwardly curved surface 138, an outwardly curved surface 142, and a generally flat end surface 146 connecting the curved surfaces 138, 142. The cam 118 engages a portion of the first arm 66 and the second arm 70 (e.g., at rollers 154, 182 on the arms 66, 70) to slide the arms 66, 70 toward and away from each other as the cam 118 rotates.

Referring to FIGS. 3A and 3B, the first arm 66 is generally C-shaped and includes a slide portion 150 configured to be received within the track 90 and a roller 154 configured to engage the cam 118. The slide portion 150 includes a groove 158 corresponding to the lower rail 98 such that the groove 158 rides along the rail 98 as the arm 66 moves. The slide portion 150 also includes an aperture 162 configured to receive a bolt 164 to limit the linear movement of the first arm 66. A passage 165 extends through the slide portion 150 and communicates with the aperture 162. The passage 165 receives a biasing element 166 (e.g., a coil spring) that contacts the bolt 164 to bias the first arm 66 away from the second arm 70. A set screw 167 is positionable within the passage 165 to retain the biasing element 166 within passage 165.

The roller 154 extends rearwardly from the slide portion 150 and rides along the surfaces 138, 142, 146 of the cam 118. In the illustrated embodiment, the roller 154 includes a shaft 167 and a sleeve 168 surrounding a portion of the shaft 167 such that the sleeve 168 is rotatable relative to the shaft 167. As the cam 118 rotates and the sleeve 168 contacts the surfaces 138, 142, 146, the first arm 66 slides within the track 90 relative to the head housing 62.

The first arm 66 supports a punch 170 on an end opposite from the slide portion 150. The illustrated punch 170 is generally cylindrical and includes a contoured surface 174 to cut or punch a circular hole in a stud. In other embodiments, the punch 170 may be pyramidal, irregular, or the like, to punch a different shaped hole in the stud. In some embodiments, multiple punches 170 may be positioned on the first arm 66 to simultaneously punch multiple holes in the stud.

The second arm 70 is generally C-shaped and, similar to the first arm 66, includes a slide portion 178 configured to be received within the track 90 and a roller 182 for engaging the cam 118. The slide portion 178 includes a groove 186 corresponding to the upper rail 94 such that the groove 186 rides along the rail 94 as the arm 70 moves. The slide portion 178 also includes an aperture 188 for receiving the bolt 164, which limits linear movement of the second arm 70. In the illustrated embodiment, the slide portion 178 of the second arm 70 is positioned on top of the slide portion 150 of the first arm 66 such that the apertures 162, 188 of each arm 66, 70 are generally aligned and the bolt 164 extends therethrough. However, it should be readily apparent to those of skill in the art that the relative positioning of the arms 66, 70 may be reversed. A passage 189, similar to the passage 165 in the first arm 66, extends through the slide portion 178 and communicates with the aperture 188. The passage 189 receives a biasing element 190 (e.g., a coil spring) that contacts the bolt 164 to bias the second arm 70 away from the first arm 66. A set screw 191 is positionable within the passage 189 to retain the biasing element 190 within the passage 189.

The roller 182 extends rearwardly from the slide portion 178 and rides along the surfaces 138, 142, 146 of the cam 118. Similar to the roller 154 of the first arm 66, the roller 182 includes a shaft 191 and a sleeve 192 such that the sleeve 191 contacts cam 118 and is rotatable relative to the shaft 191.

The second arm 70 supports a die 194 at an end opposite from the slide portion 178. The illustrated die 194 is positioned within a bore 196 extending through the second arm 70 such that a plug, chips, and/or shavings cut from a stud may be easily removed from the die 194 and the bore 196. In other embodiments, the die 194 may be integrally formed as a single piece with the bore 196. As shown in FIG. 4, the die 194 is positioned substantially opposite the punch 170 such that the die 194 receives the punch 170 as the first arm 66 and the second arm 70 come together. As such, it should be readily apparent to those of skill in the art that the die 194 generally corresponds to the shape and size of the punch 170. In embodiments where the first arm 66 includes multiple punches, the second arm 70 may support multiple dies corresponding to the multiple punches.

In the illustrated embodiment, a first guide plate 198 is positioned between the second arm 70 and an upper portion of the track 90 and a second guide plate 202 is positioned between the first arm 66 and a lower portion the track 90. The guide plates 198, 202 provide a relatively smooth surface along which the arms 66, 70 slide, reducing friction and wear on the arms 66, 70.

In some embodiments, an insert feeder (not shown) may be positioned on either of the first arm 66 or the second arm 70 to supply an insert (e.g., a plastic bushing, grommet, insulator, etc.) to a stud. As the first and second arms 66, 70 come together and punch a hole in the stud, the insert may be automatically pressed or snapped around the circumference of the hole, reducing any sharp edges that may result from punching the hole.

Figure 4B:
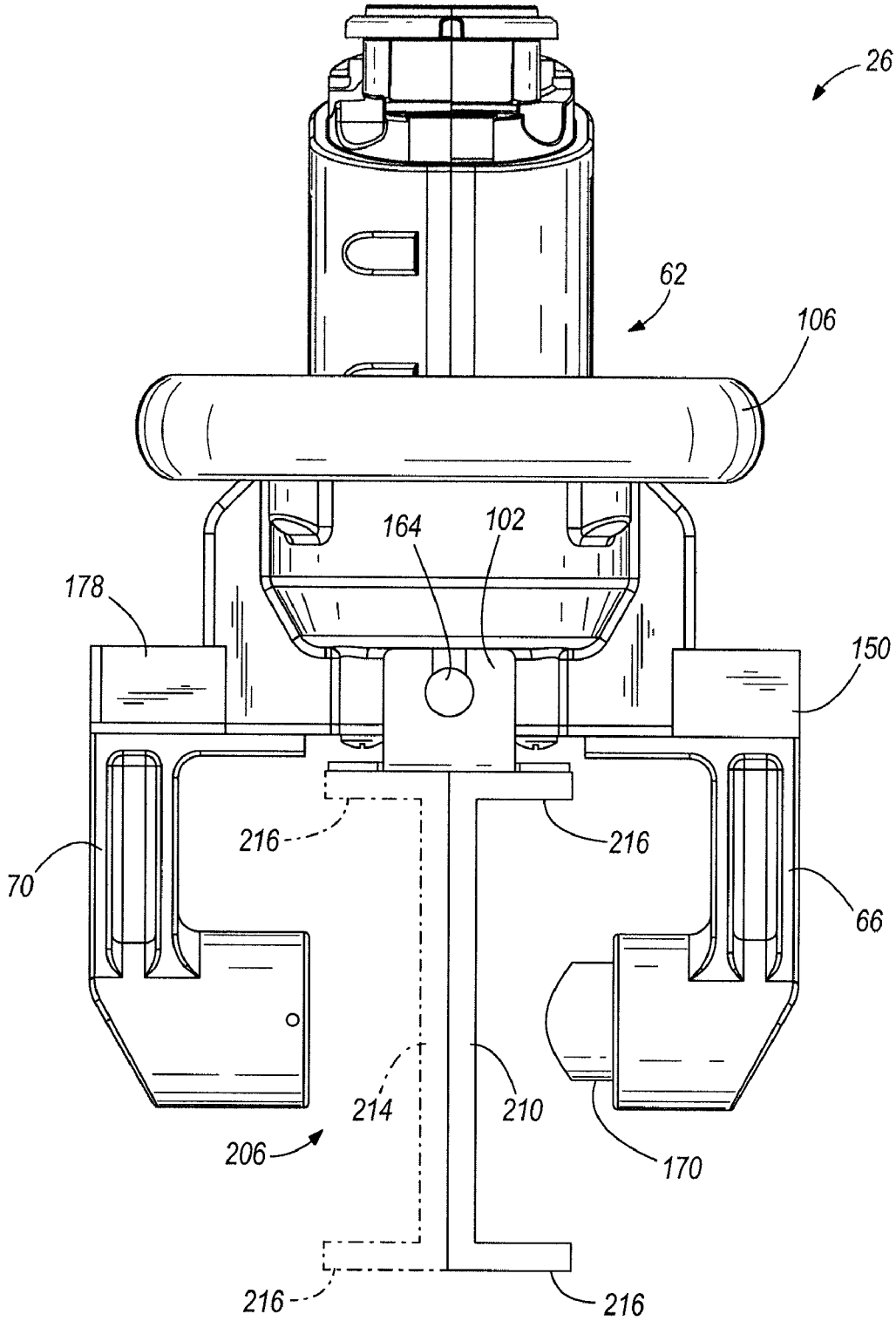
FIG. 4B is a top view of the stud punch head shown in FIG. 4A.
Figure 5:
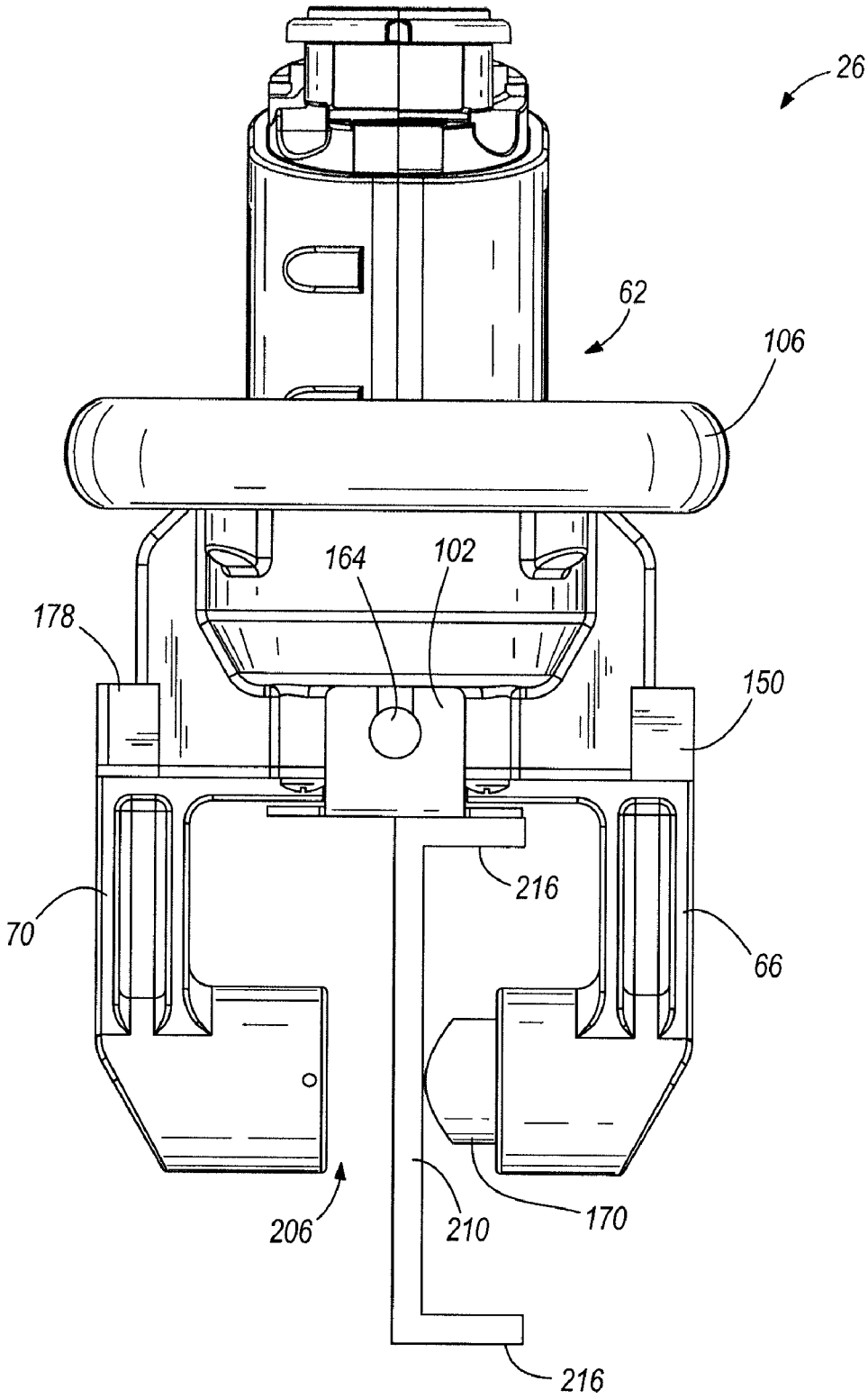
FIG. 5 is a top view of the stud punch head shown in FIG. 3A, with the arms in a partially closed position.

As shown in FIGS. 4B, 5, and 6, the first arm 66 and the second arm 70 define a slot 206 for receiving a stud 210. Referring to FIG. 4B, the arms 66, 70 are designed (e.g., in the C-shape) such that the slot 206 is sized and shaped to receive a stud 210 opening toward the first arm 66 and/or a stud 214 opening toward the second arm 70. Since both arms 66, 70 move with respect to the head housing 62, the stud punch 10 is operable to punch a hole in the studs 210, 214 without crushing a flange 216 of either stud 210, 214, regardless of the orientation of the studs 210, 214. In the illustrated construction, the slot 206 is sized and shaped to receive both of the studs 210, 214 in a back-to-back arrangement. In some embodiments, the stud punch head 26 may include an over-center latch such that the slot 206 may receive a variety of stud sizes (e.g., 2×4, 2×6, 2×8, etc.). In such embodiments, the latch may be opened, allowing a user to move the arms 66, 70 toward or away from the front portion 82 of the head housing 62, and then closed, locking the arms 66, 70 at the desired distance from the front portion 82.

When a user depresses the trigger 50 (and, if necessary, depresses the switch on the handle 106) a punch cycle of the stud punch head 26 begins. The power supply 22 provides power to the motor 18, rotating the motor 18 and, thereby, the motor shaft 54. The motor shaft 54 rotates the gears within the gear box 110 to rotate the drive shaft 114. The drive shaft 114 rotates the cam 118, causing the rollers 154, 182 of the first and second arms 66, 70 to ride along the surfaces 138, 142, 146 of the cam wings 130, 134. As the rollers 154, 182 ride along the surfaces 138, 142, 146, the arms 66, 70 move between the open position (FIG. 4B), a partially open position (FIG. 5), the closed position (FIG. 6), and back to the open position. In some embodiments, the stud punch 10 may be configured such that the arms 66, 70 only cycle (e.g., come together and spread apart) once when the user depresses the trigger 50. In other embodiments, the arms 66, 70 may continuously cycle until the user releases the trigger 50.

Referring to FIG. 4B, the stud punch head 26 is positioned about the stud 210 (or studs 210, 214) such that the stud 210 is within the slot 206 and opening toward either the first arm 66 or the second arm 70. The stud punch head 26 is positioned such that the end bracket 102 rests against the stud 210, ensuring a punch is made at the desired punching location on the stud 210. If necessary, the end bracket 102 may be moved relative to the head housing 62 to adjust the desired location. As the cam 118 rotates, the arms 66, 70 come together and the punch 170 on the first arm 66 contacts one side of the stud 210 while the die 194 of the second arm 70 contacts an opposite side of the stud 210, as shown in FIG. 5. The cam 118 continues to rotate, causing the punch 170 to cut or punch through the stud 210 and slide within the die 194, as shown in FIG. 6, thereby creating a hole in the stud 210. Once the arms 66, 70 have come together a predetermined distance (e.g., approximately the thickness of the stud 210) and punched the hole in the stud 210, the arms 66, 70 begin to move apart. The continuous rotation of the cam 118 and the bias of the biasing elements 166, 190 causes the first and second arms 66, 70 to slide back to the deactivated position (FIG. 4B), and the punch cycle may begin again. In some embodiments, a reverse switch may be provided on the stud punch 10 such that the stud punch head 26 may cycle in the opposite direction (i.e., the cam 118 is rotated in the opposite direction). Additionally or alternatively, the stud punch head 26 may include a release lever such that the first and second arms 66, 70 may be released from the cam 118, allowing a user to manually spread the arms 66, 70 apart.

Figure 7:
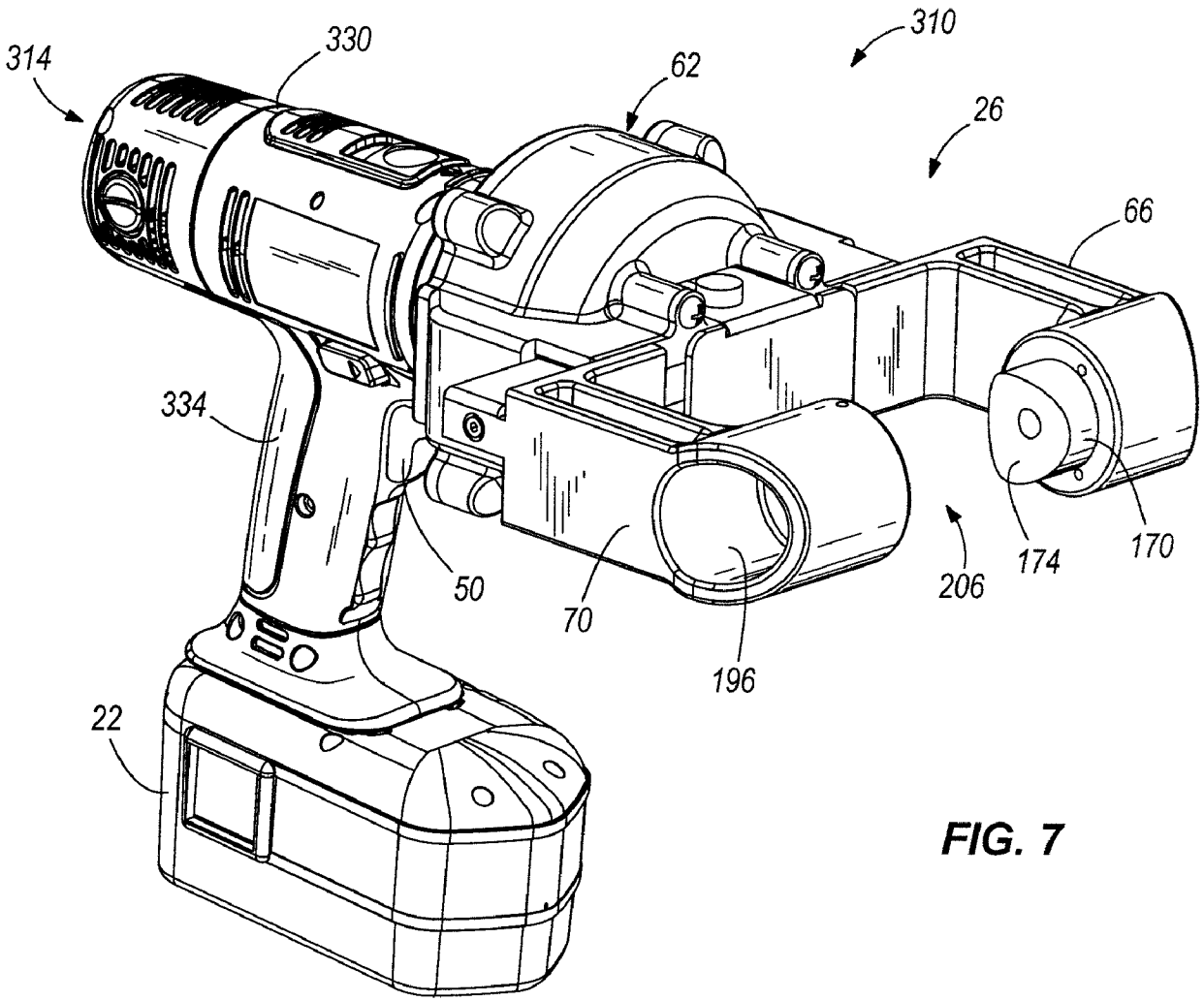
FIG. 7 is a perspective view of a stud punch according to another embodiment of the invention.

FIG. 7 illustrates another stud punch 310 according to the present invention. The stud punch 310 is similar to the stud punch 10 discussed above, and like parts have been given the same reference numbers. In the illustrated construction, the stud punch head 26 is coupled to a pistol shaped housing 314. The housing 314 includes a first portion 330 coupled to the stud punch head 26 and housing the motor 18, and a second portion 334 extending substantially perpendicularly from the first portion 330. The illustrated stud punch 310 is generally more compact than the stud punch 10 discussed above, but does not allow a user to pivot the second housing portion 334 relative to the first housing portion 330.

The stud punches 10, 310 provide a power tool that requires less physical exertion by a user as compared to currently available mechanical versions. In addition, the stud punches 10, 310 are configured to receive and punch holes in studs opening in either direction, or even in studs arranged in a back-to-back arrangement. In either arrangement, the stud punches 10, 310 are operable to punch the holes without crushing a flange of the studs. Furthermore, the stud punches 10, 310 are operable to punch holes in at least about sixteen gauge steel studs.

Various features and advantages are set forth in the following claims.

What is claimed is:

1. A stud punch head for a power tool, the stud punch head comprising:

a head housing;

a first arm including a first roller movably coupled to the head housing, the first arm supporting a punch;

a second arm including a second roller movably coupled to the head housing and relative to the first arm, the second arm supporting a die opposite the punch; and a drive mechanism positioned at least partially within the head housing and operatively coupled to a motor of the power tool, the drive mechanism including a cam having two wings, each wing including an inwardly curved surface, an outwardly curved surface, and an end surface connecting the inwardly curved surface and the outwardly curved surface, the cam being configured to be rotated by the motor to at least move the first arm and the second arm toward each other, and the cam also being configured to engage the first roller and the second roller such that the first roller and the second roller ride along an associated inwardly curved surface of the cam to move the first arm and the second arm.

2. The stud punch head of claim 1, wherein the head housing includes a track for receiving a portion of the first arm and a portion of the second arm, and further wherein the first arm and the second arm slide within the track.

3. The stud punch head of claim 2, wherein the portion of the first arm and the portion of the second arm are linearly displaced as the first arm and the second arm translationally slide within the track.

4. The stud punch head of claim 1, wherein the first arm and the second arm are biased away from each other.

5. The stud punch head of claim 1, and further comprising an end bracket coupled to the head housing and positioned between the first and second arms, wherein during a punching operation a stud rests against the end bracket to position the punch and the die proximate a desired punching location on the stud.

6. The stud punch head of claim 5, wherein the end bracket is movable relative to the head housing to adjust the desired punching location relative to the punch and the die.

7. The stud punch head of claim 1, further comprising a handle coupled to the head housing.

8. The stud punch head of claim 1, wherein the first arm and the second arm define a slot therebetween for receiving a stud, the stud opening toward either of the first arm and the second arm.

9. The stud punch head of claim 8, wherein the first arm and the second arm move between a deactivated position, in which the slot is sized to receive the stud, and an activated position, in which the die receives a portion of the punch.

10. The stud punch head of claim 1, wherein the first arm and the second arm define a slot therebetween for receiving a first stud and a second stud positioned adjacent to the first stud, the first stud opening toward the first arm and the second stud opening toward the second arm.

11. The stud punch head of claim 1, wherein the first arm and the second arm translationally move toward each other.

12. The stud punch head of claim 1, wherein a portion of one of the first arm and the second arm is supported by and slidable along a portion of the other of the first arm and the second arm.

13. The stud punch head of claim 1, wherein the cam is rotatable about a cam axis, wherein the first roller is rotatable about a first axis extending parallel to the cam axis, and wherein the second roller is rotatable about a second axis extending parallel to the cam axis.

14. A power tool comprising:

a housing;

a motor positioned substantially within the housing; and a stud punch head coupled to the housing, the stud punch head including a first arm including a first roller movable with respect to the housing, the first arm supporting a punch, a second arm including a second roller movable with respect to the housing, the second arm supporting a die opposite the punch, and a drive mechanism operatively coupled to the motor, the drive mechanism including a cam having two wings each wing including an inwardly curved surface, an outwardly curved surface, and an end surface connecting the inwardly curved surface and the outwardly curved surface, the cam being configured to be rotated be the motor to at least move the first arm and the second arm toward each other, and the cam also being configured to engage the first roller and the second roller such that the first roller and the second roller ride along an associated inwardly curved surface of the cam to move the first arm and the second arm.

15. The power tool of claim 14, wherein the stud punch head includes a head housing coupled to the housing, and wherein the head housing includes a track for receiving a portion of the first arm and a portion of the second arm, and further wherein the first arm and the second arm slide within the track.

16. The power tool of claim 15, wherein the portion of the first arm and the portion of the second arm are linearly displaced as the first arm and the second arm translationally slide within the track.

17. The power tool of claim 14, wherein the stud punch head further includes an end bracket coupled to the housing and positioned between the first and second arms, and further wherein during a punching operation a stud rests against the end bracket to position the punch and the die proximate a desired punching location on the stud.

18. The power tool of claim 17, wherein the end bracket is movable relative to the head housing to adjust the desired punching location relative to the punch and the die.

19. The power tool of claim 14, wherein the first arm and the second arm define a slot therebetween for receiving a stud, the stud opening toward either of the first arm and the second arm.

20. The power tool of claim 14, wherein the first arm and the second arm define a slot therebetween for receiving a first stud and a second stud positioned adjacent to the first stud, the first stud opening toward the first arm and the second stud opening toward the second arm.

21. The power tool of claim 14, wherein the housing includes a first portion and a second portion pivotally coupled to the first portion, the second portion being movable between a first position, in which the first portion and the second portion are generally inline, and a second position, in which the second portion is bent relative to the first portion.

22. The power tool of claim 14, wherein the first arm and the second arm translationally move toward each other.

23. The power tool of claim 14, wherein the motor includes a motor shaft rotatable about a shaft axis, wherein the first roller is rotatable about a first axis extending parallel to the shaft axis, and wherein the second roller is rotatable about a second axis extending parallel to the shaft axis.

24. A power tool comprising:

a housing;

a motor positioned substantially within the housing;

a first arm including a first roller movably coupled to the housing, the first arm supporting a punch;

a second arm including a second roller movably coupled to the housing and relative to the first arm, the second arm supporting a die opposite the punch; and a drive mechanism positioned at least partially within the housing and operatively coupled to the motor, the drive mechanism including a cam having two wings, each wing including an inwardly curved surface, an outwardly curved surface and an end surface connecting the inwardly curved surface and the outwardly curved surface, the cam being configured to be rotated by the motor to move the first arm and the second arm at least from a first position, in which the punch is spaced apart from the die, to a second position, in which the die receives a portion of the punch, and the cam also configured to engage the first roller and the second roller such that the first roller and the second roller ride along an associated inwardly curved surface of the cam to move the first arm and the second arm.

25. The power tool of claim 24, wherein the housing includes a track for receiving a portion of the first arm and a portion of the second arm, and further wherein the first arm and the second arm slide within the track.

26. The power tool of claim 25, wherein the portion of the first arm and the portion of the second arm move translationally and are linearly displaced as the first arm and the second arm move from the first position to the second position.

27. The power tool of claim 24, wherein the first arm and the second arm are biased to the first position.

28. The power tool of claim 24, wherein the first arm and the second arm cycle from the first position to the second position and back to the first position to perform a punching operation.

29. The power tool of claim 24, wherein the first arm and the second arm define a slot therebetween for receiving a stud, the stud opening toward either of the first arm and the second arm.

30. The power tool of claim 29, wherein when the first arm and the second arm are in the first position the slot is sized to receive the stud, and further wherein when the first arm and the second arm are in the second position the punch cuts a hole in the stud.

31. The power tool of claim 24, wherein the first arm and the second arm define a slot therebetween for receiving a first stud and a second stud positioned adjacent to the first stud, the first stud opening toward the first arm and the second stud opening toward the second arm.

32. The power tool of claim 24, wherein the first roller and the second roller move translationally and are linearly displaced as the first arm and the second arm move from the first position to the second position.

* * * * *